US006079778A

United States Patent [19]

Lindberg

[11] Patent Number: 6,079,778

[45] Date of Patent: Jun. 27, 2000

[54] PADDED CHAIR COVER AND METHOD FOR COVERING CHAIRS

[76] Inventor: Nafiseh Lindberg, 2671 Marshall Dr., Palo Alto, Calif. 94303

[21] Appl. No.: 09/014,498

[22] Filed: Jan. 28, 1998

Related U.S. Application Data

[60] Provisional application No. 60/037,263, Jan. 31, 1997.

[51] Int. Cl.[7] ..... A47C 31/00

[52] U.S. Cl. ..... 297/223; 297/228.11; 297/229; 297/223

[58] Field of Search ..... 297/229, 219.1, 297/228.1, 228.12, 225, 228.11, 223; 5/417, 420, 485, 497, 490

[56] References Cited

U.S. PATENT DOCUMENTS

D. 276,103 10/1984 Turner et al. .

D. 280,481 9/1985 Kornegay .

D. 303,473 9/1989 Sheinman .

D. 331,346 12/1992 Gayden .

*Primary Examiner*—Anthony D. Barfield

*Attorney, Agent, or Firm*—Trial & Technology Law Group

[57] ABSTRACT

A padded chair cover according to the present invention uniformly covers virtually any style of fixed chair. The chair cover includes a padded foam-type structure to cover a chair. The padding is made of a relatively rigid commercially available foam. The rigidity of the foam allows the chair cover to maintain its shape regardless of the kind or shape of chair it covers. Thus a mismatched group of chairs can be covered with the same style of chair cover producing a uniform set of chairs with a formal upholstered look.

14 Claims, 5 Drawing Sheets

PADDED CHAIR COVER AND METHOD FOR COVERING CHAIRS

CROSS REFERENCE TO RELATED APPLICATIONS

The present application is related to provisional patent application Ser. No. 60/037,263, filed Jan. 31, 1997 entitled "Padded Chair Cover For Covering Chairs", and the benefit of the earlier Jan. 31, 1997 filing date is claimed for the present application in accordance with 35 U.S.C. § 119 (e)(1).

BACKGROUND OF THE INVENTION

The present invention relates to a padded chair cover and corresponding method for covering chairs. There are a variety of slip covers for covering chairs which are commercially available in the marketplace. Each of these commercial products functions as a cover for a unique kind of chair, often a folding chair. These previously existing slip covers generally droop loosely over the specific chair and simply provide an ornamental layer of fabric over the chair. Party rental and catering companies have traditionally been the prime customers for these slip covers. All the while these same customers have been actively looking for a superior chair cover that would provide them with a formal, elegant and comfortable chair cover without having to replace their old chairs. In view of the foregoing, it would be clearly desirable to provide an improved chair cover which has these formal, elegant and comfortable chair cover features and which can cover a range of shapes of chairs thus providing a uniform appearance. Chair covers with these features are not currently available.

SUMMARY OF THE INVENTION

It is an object of the present invention to provide an improved chair cover and corresponding method for covering chairs, and more particularly a firmly shaped and padded chair cover.

The chair cover according to the present invention includes an inner structure to cover any style of chair. This structure can be made of a relatively rigid commercially available foam or any other type of material to provide a rigid inner support for the chair cover. The rigidity of the inner structure allows the chair cover to maintain its shape regardless of the kind or shape of chair it covers. Thus a mismatched group of chairs can be covered with the same style of chair cover when this inner support structure is made of foam-like material, not only producing a uniform set of chairs but with a formal upholstered look.

Other objects, features and advantages of the present invention will become apparent from the following detailed description when taken in conjunction with the accompanying drawings.

BRIEF DESCRIPTION OF THE DRAWINGS

The accompanying drawings, which are incorporated in and form a part of this specification, illustrate embodiments of the invention and, together with the following detailed description, serve to explain the principles of the invention.

DETAILED DESCRIPTION OF THE PREFERRED EMBODIMENTS

Figure 1:
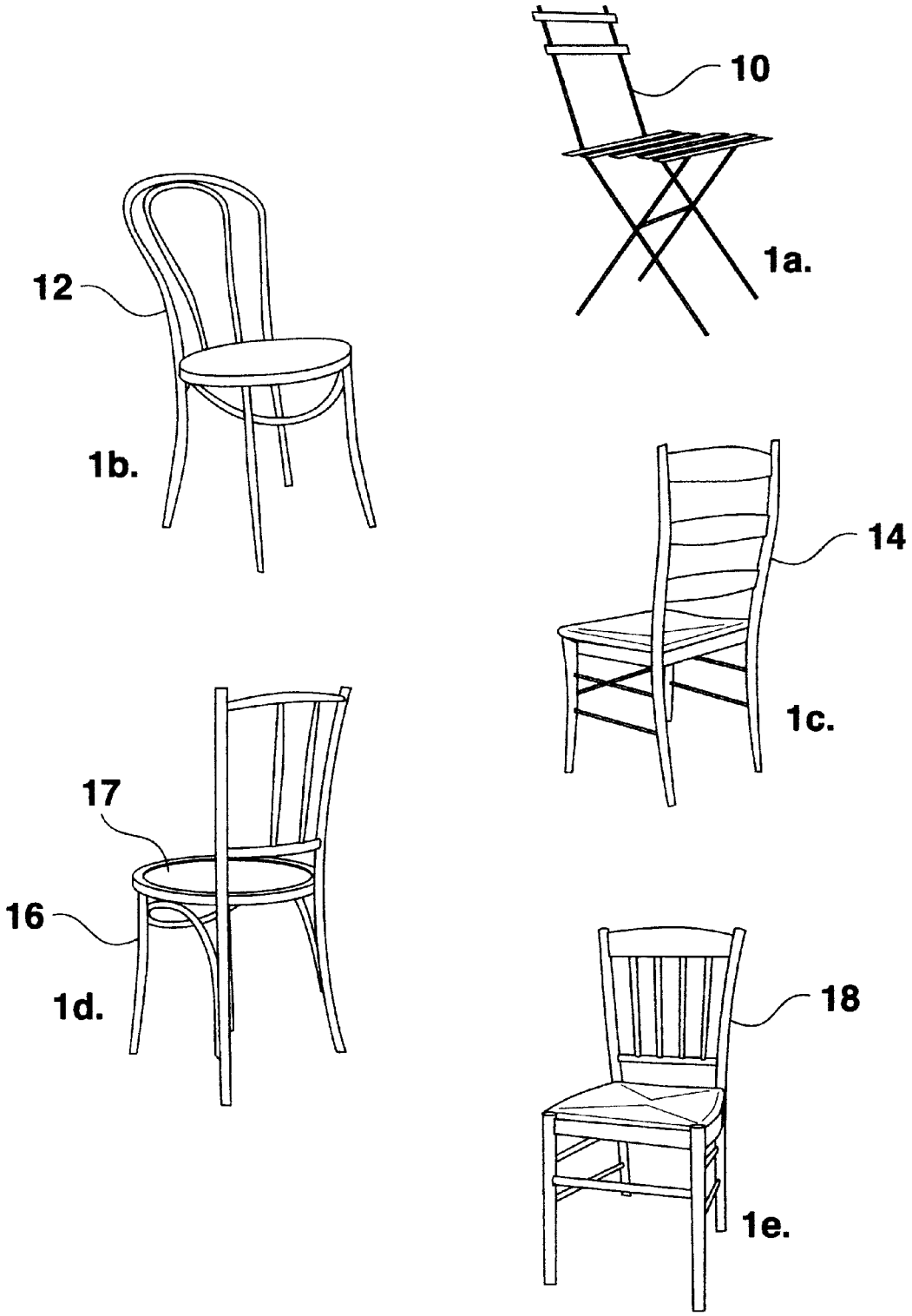
FIGS. 1*a*–1*e* show a variety of upright chairs which can be uniformly covered with the padded chair cover according to the present invention.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

FIGS. 1*a*–1*e* show a variety of upright chairs 10, 12, 14, 16, and 18, each of which can be uniformly covered with the padded chair cover 40 (shown in FIG. 3) according to the present invention. The chair cover 40 can uniformly cover any type of chair such as those upright chairs shown in FIG. 1, and including chairs such as a side chair, an arm chair, a sofa, a club chair, and any other style of seating device. FIG. 1 illustrates several styles of upright chairs which can be uniformly covered by the padded chair cover 40.

FIG. 1*a* shows a metal folding garden chair 10; FIG. 1*b* shows a rounded top cafe chair 12; FIG. 1*c* shows a ladder back dining chair 14; FIG. 1*d* shows a chair 16 with a rounded seat 17; and FIG. 1*e* shows a rush seat dining chair 18.

Figure 2:
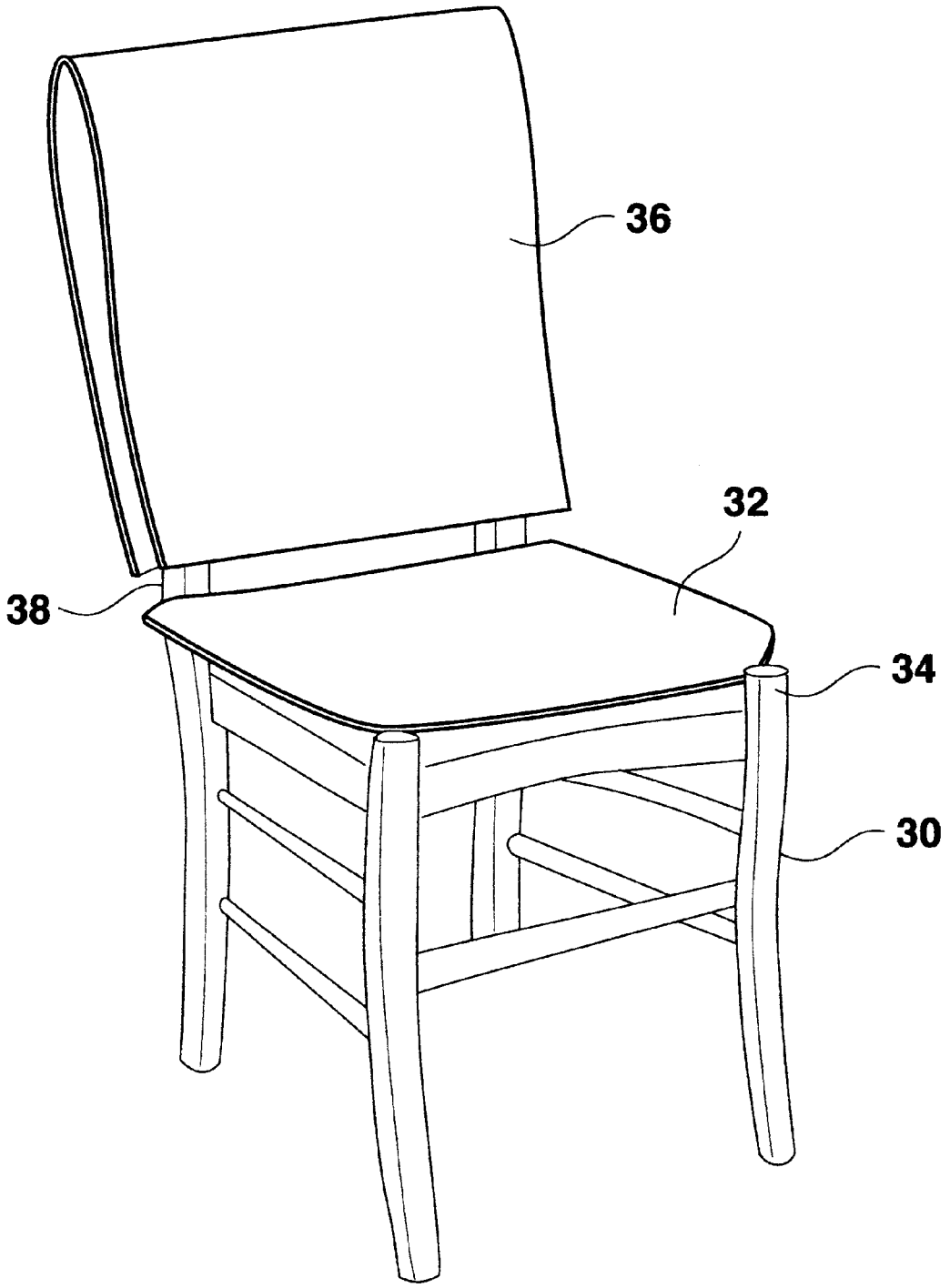
FIG. 2 shows a random style chair with foam covering the seat and back of the chair.

FIG. 2 shows a random style chair 30 with foam material 32, 36 covering the seat 34 and back 38, respectively, of the chair 30. The uniformity is obtained by the use of a relatively rigid inner support structure such as foam 32, 36 shown in FIG. 2. The foam material 32, 36 is about 1–1 ½" thick and covers the seat and the back of each chair, such as the seat 34 and back 38 shown in FIG. 2. The illustrated version of the present invention uses the above-described foam inner structure. However, this inner structure can be provided as well by a variety of other materials. The foam 32, 36 in turn, is covered by a fabric of choice, such as silk, cotton or any other material of any color and print. As described above, FIG. 2 shows a rush seat chair 30 with the foam material 32 resting on seat 34 and foam material 36 folding over back .3. chair 30 could be selected from FIG. 1 to illustrate the way each chair would be uniformly covered by the rigid foam 32. 36 and thereby converting the shape of the respective chair to that of the straight top foam 36 and almost square seat foam 32. The same concept applies to all the chairs 10, 12, 14, 16, and 18 shown in FIG. 1.

Figure 3:
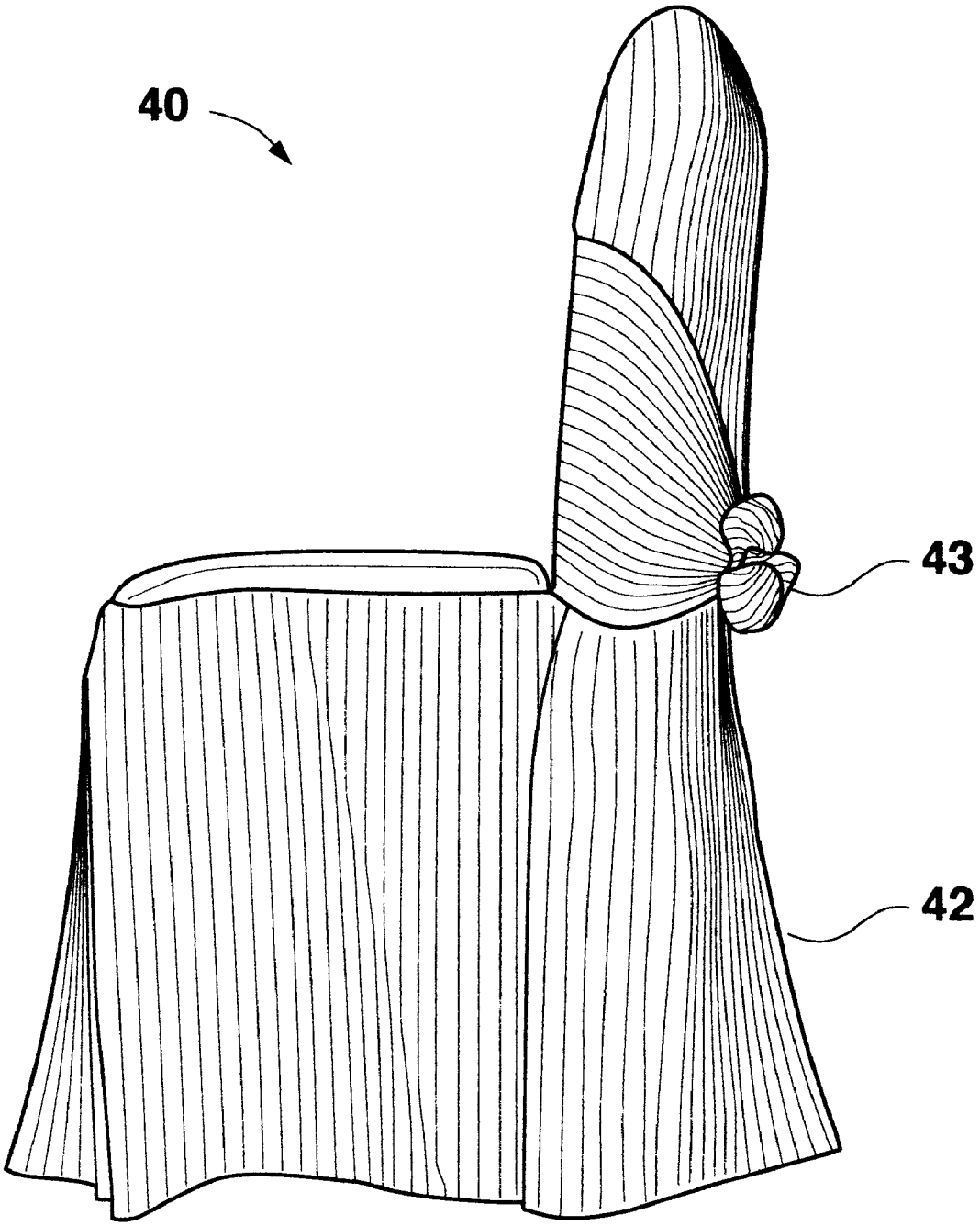
FIG. 3 shows a complete chair cover covering a chair according to the present invention.

The purpose of covering chairs 10, 12, 14, 16, and 18 in FIG. 1 with the chair cover 40 is to create a beautiful, uniformly appealing and comfortable set of chairs out of a group of mismatched and in some cases damaged chairs. In addition to comfort and uniformity, the chair cover 40 produces a beautifully upholstered look for any chair to which it is applied. FIG. 3 shows a complete chair cover 40 covering a chair according to the present invention. The chair cover 40 includes two main elements: 1)The padding, foam or other padding material, as shown in FIG. 2 which sculpts the general shape of the chair cover 40 and often conceals the original form of the chair it is covering (FIG. 2); and 2)The fabric which provides the esthetic outer part. The fabric always completely covers the padding and can be of any color and texture.

The chair cover 40 as shown in FIG. 3 serves two main purposes:

Comfort: The construction of the chair cover 40 includes inner padding in the seat, back and/or arms of the chair for comfort and shape, as shown in more detail in FIG. 5.

Style: In addition, the outside structure of chair cover 40 benefits from stylish choice of fabrics and numerous decorative designs for harmony and visual appeal.

For each category of chair styles, for example, the upright side chairs as shown in FIG. 1, certain measurements are taken and used for cutting the padding material to shape and size. For the chairs shown in FIG. 1 the important measurements are the width and depth of seat, the width and height of back and the height of seat from the floor. For chairs with arms, additional measurements are required.

Next, the fabric is cut according to an exclusive pattern and sewn together. The foam is then inserted into the fabric to complete the chair cover 40. The cover 40 is then put over the top of a chair (such as one of the chairs shown in FIG. 1) and gently pulled over it to fit the back and seat with skirt 42 softly covering the legs. Bow ties are tied to the back or side (depending on the particular design of the chair cover) in a knot or a bow tie 43, both for esthetics and for size adjustments. FIG. 3 shows the chair cover 40 for an overall finished look.

As previously described, the padding material is usually a fairly rigid 1–1.5" thick foam, such as foam material 32, 36 shown in FIG. 2. Using an exclusive pattern, the foam material is cut into a piece for the seat 34 with beveled edges and another foam material 36 with straight edges so as to fold over the back portion 38 of chair 30 as shown in FIG. 2. A chair with arms (not shown) will also have padding in the arms.

Figure 4:
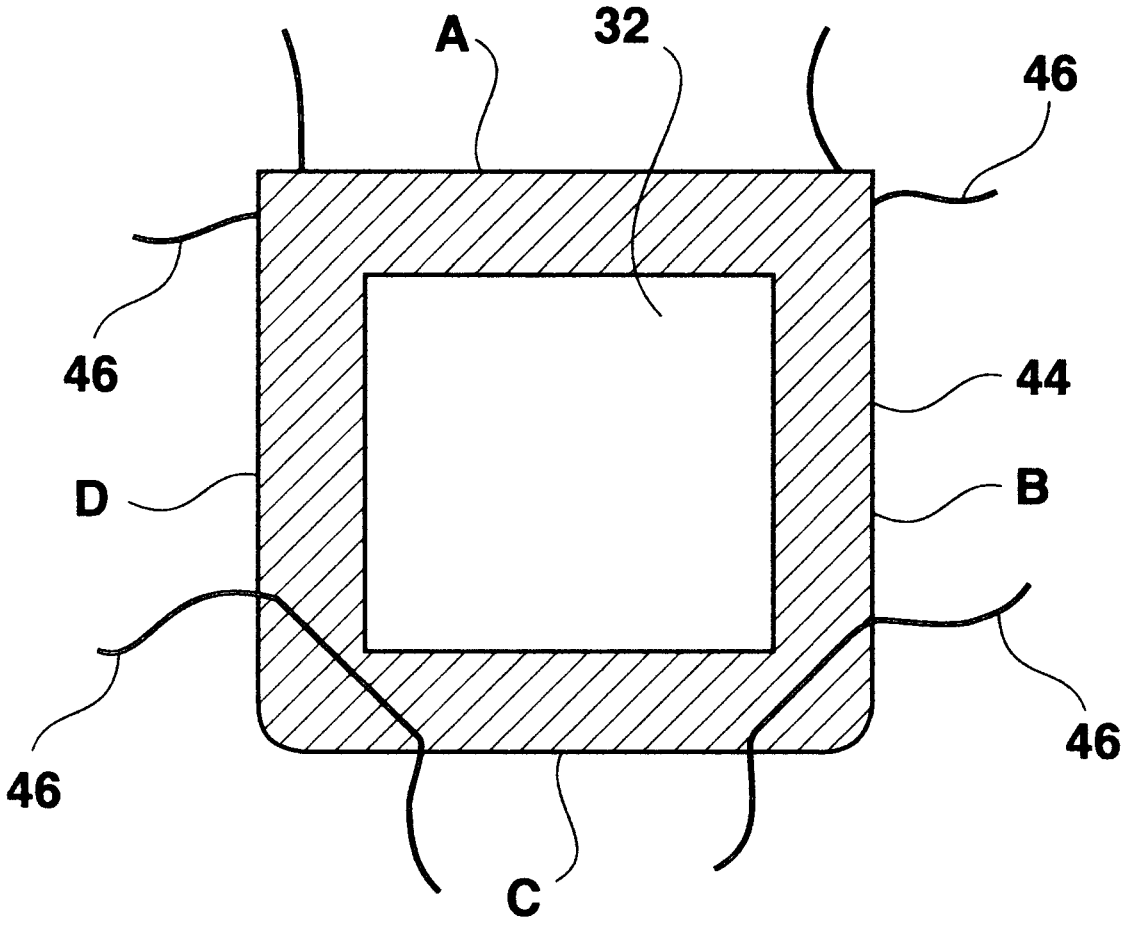
FIG.4 shows a bottom view of a chair cover seat, which forms a portion of the padded chair cover according to the present invention.

FIG. 4 shows a bottom view of the seat padding 32 of FIG. 2 and the way the seat padding 32 is inserted into the chair cover 40 of FIG. 3. As seen in FIG. 4, the seat fabric is lined with a lining fabric 44 (shaded areas) to form one continuous pocket along the perimeter of the fabric 44 having four pocket portions A, B, C, D around the seat foam 32. The continous pocket has an open part in the center of the lining 454. The seat foam 32 is then inserted in this continuous pocket with the beveled edges eventually resting on the seat of a chair, such as chair 30 of FIG. 2. In FIG. 4, there are four sets of straps 46 sewn to the four comers of the lining. The straps 46 are used for tying to the four legs of a chair for added stability.

Figure 5:
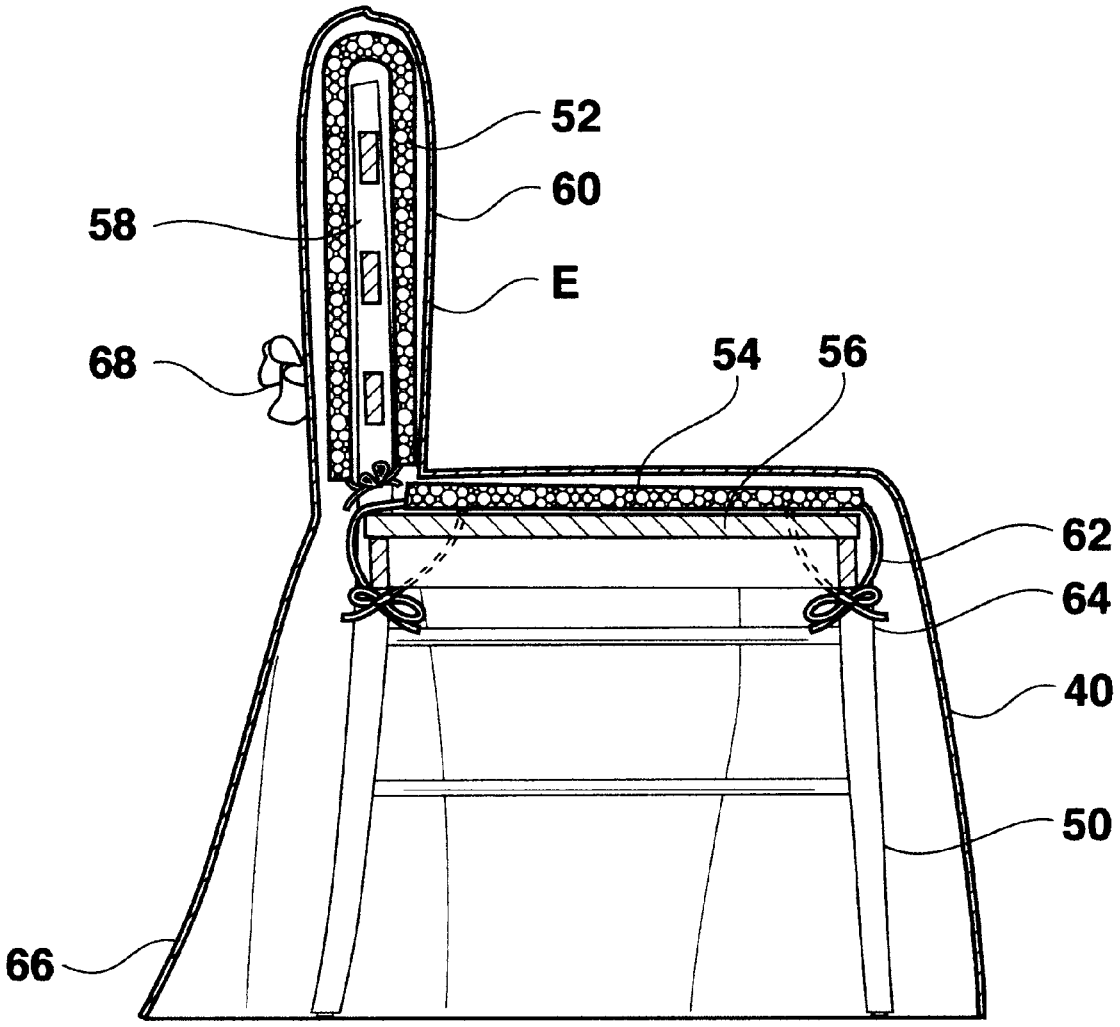
FIG. 5 shows an elevational cross-section of a chair and the padded chair cover according to the present invention.

FIG. 5 shows an elevational cross sectional view of the back of the chair cover 40 of FIG. 3 as the chair cover 40 covers a chair 50. The shaded areas 52, 54 represent the back foam and the seat foam, respectively. As shown in FIG. 5, the back portion 58 of chair 50 is sandwiched between the folded back foam 52. The two folds of the foam 52 are in turn sandwiched between the two layers of the fabric 60 (the two layers of fabric 60 have created pocket E). FIG. 5 further shows how the seat foam 54 is inserted in the fabric 60 and the lining rests on chair 50. The straps 62 are tied to legs 64.

The fabric part of the chair cover 40 is designed such that the seat has pocket underneath for holding the seat foam, as shown in FIG. 4. As a result, the seat of the chair 50 in FIG. 5 is fully covered with foam 54, which is wrapped in a decorative fabric on the outside and the lining pockets on the reverse side (as seen in FIGS. 4 and 5). The back of the chair cover fabric includes a two-layer construction which completely conceals the folded foam. In this respect, the back portion 58 of chair 50 in FIG. 5 is sandwiched between the folded foam 52 and totally covered with fabric 60. Therefore, both sides of the chair back portion 58 are covered with foam and fabric. The decorative fabric is used to form a skirt 66 which is attached to the seat and covers all or parts of the legs 64 of chair 50 in FIG. 5. The fabric is also used for other decorative elements such as a bow tie or knot 68 in the back or on the sides.

The chair cover 40 according to the present invention is neatly folded and packaged in a zippered, clear plastic bag (not shown) complete with a brochure and labeling. The decorative ties are already tied into a knot or bow tie. To put the chair cover 40 over a chair such as chair 50 in FIG. 5, the chair cover 40 is taken out of the package and unfolded. The chair cover 40 is held over the top of the chair 50 and gently brought down over chair 50 until the back foam 52 touches the top of the chair 50. The back 58 of chair 50 is directed to slide inside the two folds of the back foam 52 and the chair cover 40 is gently pulled down until the seat foam 54 of the chair cover 40 rests on the seat 56 of chair 50. The four sets of straps 62 under the seat 56 can be tied to the legs 64 by simply reaching under the skirt 66 and tying the straps 62 one leg at a time.

The foregoing descriptions of specific embodiments of the present invention have been presented for purposes of illustration and description. They are not intended to be exhaustive or to limit the invention to the precise forms disclosed, and it should be understood that many modifications and variations are possible in light of the above teaching. For example, the padded chair cover concept according to the present invention can apply to any chair such as upright chairs as previously described, arm chairs as well as any other seating device such as a sofa. An arm chair would only need extra foam folded over the respective arm(s) with fabric covering the arm padding material. Likewise, for a sofa, the foam would take the appropriate shape to the particular sofa, but the pattern would be general enough to uniformly fit many sofas. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A padded seating device cover for covering a seating device having an original form wherein said seating device has a seating portion, a back portion and a bottom portion, said padded cover comprising:

a fabric element having a general shape of a uniform seating device;

a generally rigid padding element including a padding back element and a padding seat element, said padding element formed so as allow the fabric element to maintain its general shape;

the fabric element for completely covering said padding element and said seating device, said fabric element having pockets into which said padding element is inserted such that the chair cover reshapes the original form of the seating device wherein said fabric element includes a fabric back portion with a back pocket into which said padding back element is inserted for covering the back portion of the seating device, a fabric seat portion with a seat pocket underneath the seat portion into wlhich said seat padding element is inserted for covering the seat portion of the seating device, the seat pocket having an attached a lining fabric material to form one continuous pocket along the perimeter of the seat portion and an open part in the center of the seat lining, and a skirt portion for covering a least the bottom portion or all of the bottom portion of the seating device.

2. A padded cover as in claim 1 wherein said seating device includes an arm portion and wherein said fabric element includes a fabric arm portion for covering the arm portion of said seating device.

3. A padded cover as in claim 1 wherein said fabric element includes a seating device covering portion having string ties for securing the fabric element to the seating device.

4. A padded cover as in claim 1 wherein said seating device includes a chair.

5. A padded cover as in claim 1 wherein said seating device includes an upright chair.

6. A padded cover as in claim 1 wherein said seating device includes a metal folding chair.

7. A padded cover as in claim 1 wherein said seating device includes a rounded top cafe chair.

8. A padded cover as in claim 1 wherein said seating device includes a ladder back dining chair.

9. A padded cover as in claim 1 wherein said seating device includes a rounded seat chair.

10. A padded cover as in claim 1 wherein said seating device includes a rush seat dining chair.

11. A padded cover as in claim 1 wherein said seating device includes a side chair.

12. A padded cover as in claim 1 wherein said seating device includes an arm chair.

13. A padded cover as in claim 1 wherein said seating device includes a sofa.

14. A padded cover as in claim 1 wherein said seating device includes a club chair.

* * * * *